US005758375A

United States Patent [19]

Horowitz

[11] Patent Number: 5,758,375

[45] Date of Patent: Jun. 2, 1998

[54] ADJUSTABLE BODY SUPPORT WITH IMPROVED NECK AND HEAD SUPPORT FILLED WITH GRANULAR MATERIAL

[76] Inventor: Lawrence Fraser Horowitz, 25 Godwin Ave., Fairlawn, N.J. 07410

[21] Appl. No.: 837,913

[22] Filed: Apr. 11, 1997

[51] Int. Cl.[6] ..... A47G 9/00

[52] U.S. Cl. ..... 5/640; 5/645; 5/911; 5/951

[58] Field of Search ..... 5/640, 645, 630, 5/632, 697, 636, 644, 911, 502

[56] References Cited

U.S. PATENT DOCUMENTS

| | | | |
|---|---|---|---|
| 132,686 | 10/1872 | Pack et al. . | |
| 1,212,515 | 1/1917 | Leavitt | 5/636 |
| 1,730,771 | 10/1929 | Jonas | 5/697 |
| 1,902,000 | 3/1933 | Van Slyck | 5/697 |
| 2,298,218 | 10/1942 | Madson | 5/702 |
| 2,673,357 | 3/1954 | Brandwein | 5/697 |
| 3,762,404 | 10/1973 | Sakita | 5/911 |
| 3,899,797 | 8/1975 | Gunst | 5/655.3 |
| 4,754,511 | 7/1988 | Sargent | 5/911 |
| 5,020,174 | 6/1991 | Sarkozi | 5/951 |
| 5,070,558 | 12/1991 | Fenley . | |
| 5,182,828 | 2/1993 | Alivizatos | 5/631 |
| 5,228,158 | 7/1993 | Park | 5/636 |
| 5,279,237 | 1/1994 | Alivizatos | 5/655 |
| 5,363,524 | 11/1994 | Lang | 5/645 |
| 5,375,278 | 12/1994 | Van Winkle | 5/644 |
| 5,475,886 | 12/1995 | Mintz | 5/636 |
| 5,528,784 | 6/1996 | Painter | 5/636 |
| 5,572,757 | 11/1996 | O'Sullivan | 5/636 |

FOREIGN PATENT DOCUMENTS

| | | | |
|---|---|---|---|
| 405161532 A | 6/1993 | Japan | 5/911 |

*Primary Examiner*—Alexander Grosz
*Attorney, Agent, or Firm*—Daniel S. Kirshner

[57] ABSTRACT

An improved body support or bed pillow. A pillow cover is provided which is formed by sewing together two pieces of material. On the interior face of each of the two pieces of material are sewn a plurality of loops of material. A drawstring is fed through the loops of material from one side of the pillow cover to the other in a zigzag pattern. The body support is filled with granular material such as natural buckwheat. By pulling the drawstrings taut, the pillow is segmented into two distinct sections; one section may be utilized to support the head and neck of the sleeper and the other to support the body. The drawstrings are held in their tightened positions by tying them together or by proving a common drawstring brake thereby defining a neck roll portion of the body support.

10 Claims, 2 Drawing Sheets

ADJUSTABLE BODY SUPPORT WITH IMPROVED NECK AND HEAD SUPPORT FILLED WITH GRANULAR MATERIAL

FIELD OF THE INVENTION

The present invention relates generally to body supports or pillows, and more particularly to a body support that includes means to distribute a granular filler contained therein thereby providing improved head and neck support.

BACKGROUND OF THE INVENTION

In order to survive and to perform their daily activities safely and efficiently, human beings need to sleep. Most people utilize some type of pillow or body support to sleep more comfortably and to cushion their back and head. For many sleepers, conventional pillows or body supports do not provide adequate protection for the head and neck. As a result, countless people do not rest adequately thereby impairing their day to day activities. Worse, improper support for the head or back may lead to pain or injury, thereby resulting in down time from work, inability to perform day to day activities, and sometimes leading to surgery or other medical intervention.

Many prior attempts have been made to resolve some of the problems resulting from the lack of comfort provided by conventional pillows or body supports. Orthopedic pillows and pillow cases have been developed to provide support to a person's neck and/or lower back. For example, U.S. Pat. No. 5,572,757 entitled Body Support Having Hingedly Connected Semi-Cylindrical Cushions to O'Sullivan attempts to provide support to the head and neck of a user by utilizing two cushions. Each of O'Sullivan's cushions is semi-cylindrical in configuration and they are hingedly connected. O'Sullivan teaches placing one of the cushions underneath the head of the sleeper and the other underneath the neck, thereby separately supporting each body part. O'Sullivan's body support suffers from the disadvantage that the cushions are relatively fixed in configuration, i.e. there is no way to redistribute the contents or filling of the cushions. Furthermore, O'Sullivan discloses filling his body support with a resilient material, which may be less conformable to the contours of the sleeper than a natural granular material.

The advantages use of beads or granular materials is also well known in the prior art. In comparison with feathers, down, foam or other similar materials, a granular material is less likely to lose its resiliency due to compression. Furthermore, many people suffer an allergic reaction when sleeping on feathers or down. Thus, several prior art patents disclose the use of granular or beadlike fillings in pillows or body supports. U.S. Pat. No. 3,459,179 issued to Olesen on Aug. 5, 1969 entitled Supporting Pad with Massaging Means is exemplary. The use of a natural granular material in body supports has also been previously disclosed in the prior art. U.S. Pat. No. 5,375,278 to Van Winkle entitled Therapeutic Pillow and Method discloses a therapeutic pillow for applying heat or cold for ameliorating discomfort. Van Winkle teaches that the "[u]se of naturally occurring granular and grain-like materials provides 'live' weight and mass to the therapeutic pillow. Accordingly, the therapeutic pillow can be shaped to conform to any given anatomical area, be it arms, neck, spine and the like. Further, because of its weight and mass, such conformable shapes will tend to be maintained while in position against the body part." Van Winkle's preferred embodiment for his body support includes the use of natural barley as the filling material.

Also known in the prior art is the use of a tie or drawstring to reconfigure the shape of a body support or pillow. Examples include U.S. Pat. No. 5,070,558 to Fenley entitled Decorative Pillow. Fenley teaches the use of a cincture which transforms the pillow from a first configuration to a second desired configuration. In Fenley, the tie is wrapped around the outside of a pillow which is formed from foam or other such resiliently deformable material. Fenley, however, is strictly a decorative pillow; it does not address the problem of separately supporting individual body parts like the head and neck.

It would be an advantage to provide a body support device that provides individualized support for the head and neck regions of the user. It would further be an advantage to utilize a granular material to fill the body support device, preferable a natural granular material. Further, it would be an advantage to provide a means for redistributing the material that fills the body support in order to separately support the head and neck of the user.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

SUMMARY OF THE INVENTION

The present invention is an improved body support or bed pillow. A pillow cover is provided which is formed by sewing together two substantially rectangular pieces of material. On the interior face of each of the two pieces of material are sewn a plurality of loops of material which are positioned in a line parallel to the longer sides and approximately one-third of the distance along the shorter sides. A drawstring is fed through the loops of material from one side of the pillow cover to the other in a zigzag pattern. The body support is filled with granular material such as natural buckwheat hull. By pulling the drawstrings taut, the pillow is segmented into two distinct sections; one section may be utilized to support the head and neck of the sleeper and the other to support the body. The drawstrings exit the pillow through a pair of reinforced buttonholes. The drawstrings are held in their tightened positions by tying them together or by proving a common drawstring brake. A separate pillowcase is provided. The pillowcase has one open short side and an drawstring aperture on the other short side.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

The present invention is an improvement in the area of body supports or bed pillows. The invention provides a novel improvement by providing a means to redistribute a granular filling in order to provide a neck roll for the support of the head and neck of the user.

Figure 1:
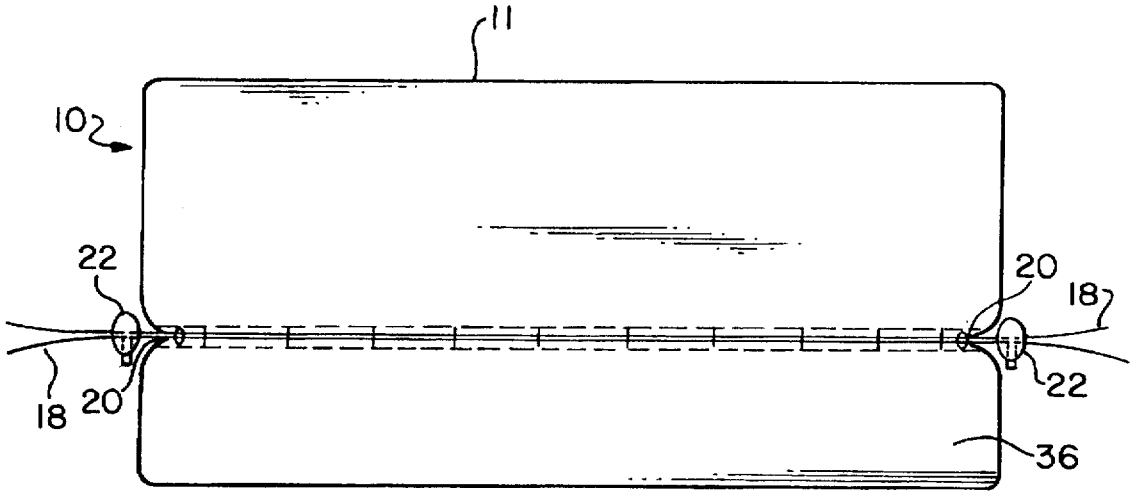
FIG. 1 is a top view of the body support of the present invention.
Figure 2:
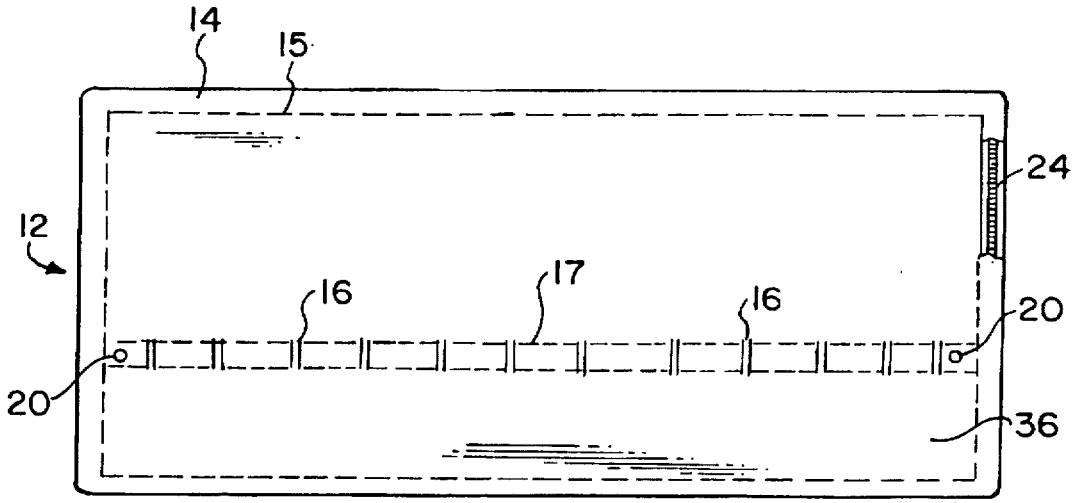
FIG. 2 is a top view of the interior face of one side of the pillow cover of the present invention body support.

Referring to FIG. 1, the body support or pillow 10 of the present invention is depicted. The pillow 10 is formed by sewing together two rectangular pieces of material 12, one of which is depicted in FIG. 2. The pillow 10 is manufactured from material with a mesh that is fine enough to retain a granular stuffing without exiting therethrough as is well known in the art. More specifically, the pillow 10 of the preferred embodiment is generally rectangular and may be formed by sewing together two rectangular pieces of material 12 along the periphery. By sewing together the two pieces of material, a pillow cover 11 is formed which defines a pocket for pillow stuffing. More particularly, as can be seen in FIG. 2, a hem 14 is folded the edge of each of the two pieces of material 12. A line of stitching 15 is sewn around the periphery of each of the pieces of material approximately ½ inch from the edge in order to secure the hem 14. The hem 14 of each of the two pieces of material 12 is sewn to the corresponding hem of the other piece of material thereby forming a pillow cover 11 which defines a space or pocket to retain pillow stuffing. The preferred measurements of the body support 10 contemplates that the shorter side measures approximately 18 inches and the longer side measures approximately 23 inches.

Referring again to FIG. 2, a plurality of loops 16 are sewn on the interior face of each of the two pieces of material 12. The loops 16 are preferable manufactured from strips of material and can be the same material as the pillow cover. In the preferred embodiment of the body support 10, the loops 16 are attached in a line which is parallel to the longer edges of the rectangular pieces of material 12 and are situated approximately one-third of the distance from one of the longer edges. The loops 16 are attached to the interior face of the piece of material 12 by sewing a line of stitching 17 as depicted in FIG. 2. Thus, each loop 16 defines an opening between itself and the rectangular piece of material 12 whereby said opening is substantially perpendicular to the longer of edges of the material 12.

Figure 3:
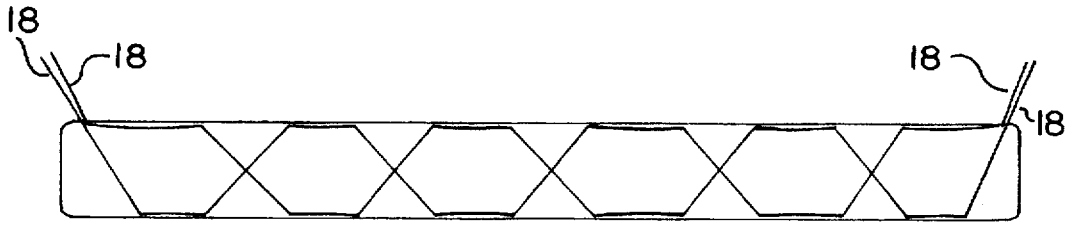
FIG. 3 is a diagrammatic view of the pattern of the drawstring fed through the loops on the interior face of the pillow cover of the present invention.

Two drawstrings 18 which function to partition the pillow filling as well as means for redistribution of filling are provided. As depicted in FIG. 3, the drawstrings 8 are fed in a zig-zag pattern through the loops 16 that are situated on the interior face of each of the rectangular pieces of material. Specifically, a drawstring 18 is fed through a loop 16 on one of the rectangular pieces of material 12. Next, the same drawstring 18 is fed through the next loop 16 in line on the opposite piece of material 12. Each drawstring 18 is repeatedly fed back and forth from one side to other thereby forming the zig-zag pattern as is evident in FIG. 3.

The two drawstrings 18 exit each of the shorter sides of the pillow cover through the buttonholes 20. The buttonholes 20 are sized so that they allow the two drawstrings 18 to fit therethrough, yet small enough that a granular filling cannot exit the pillow cover. The buttonholes 20 are reinforced by stitching the material around the buttonhole so that the size and configuration of the buttonholes 20 remain constant. The two drawstring 18 are of substantially equal length and may be tied at each end to prevent the looped drawstring 18 from pulling into the interior of the pillow cover. In the preferred embodiment, a pair of brakes 22 are provided. The brakes 22 are be utilized to readily adjust the extent to which the drawstring 18 is pulled tight. Said brakes 22 are common, off the shelf, brakes of the type utilized on drawstrings of sleeping bags and the like. The brakes 22 comprise a generally tubular structure wherein the drawstring 18 is fed through the cavity therein. A spring loaded piston is situated through a cavity on one of the sidewalls of the brake 22. The spring is biased to retain tension on the drawstring 18. By abutting on the pillow cover, the brakes 22 prevent the drawstring from pulling into the interior of the pillow. A user may adjust the positioning of the drawstring 18 by depressing the spring loaded piston thereby releasing the tension on the drawstring.

The body support 10 is filled with a granular material which is advantageous because said natural granular material may readily be redistributed by adjusting the tension on the drawstrings 18. Furthermore, a granular material easily adapts or conforms to the contours of the user. The preferred granular material is natural buckwheat hull because natural buckwheat hull is readily available, provides comfortable support for a user, and is non-allergenic for most users. It is also contemplated that other natural materials such as barley or wheat berries may be utilized, or other granular materials such as plastic beads may be used.

A zippered aperture 24 is provided along one of the sides of the body support 10 and the natural granular material is introduced into the body support therethrough. The zipper is any common off the shelf zipper as is well known in the prior art, and in the preferred embodiment of the present invention the zipper measures five inches in length. By opening the zippered aperture, the user has the option of increasing the amount of granular filling in the pillow thereby providing firmer support, or conversely, reducing the filling content.

Figure 4:
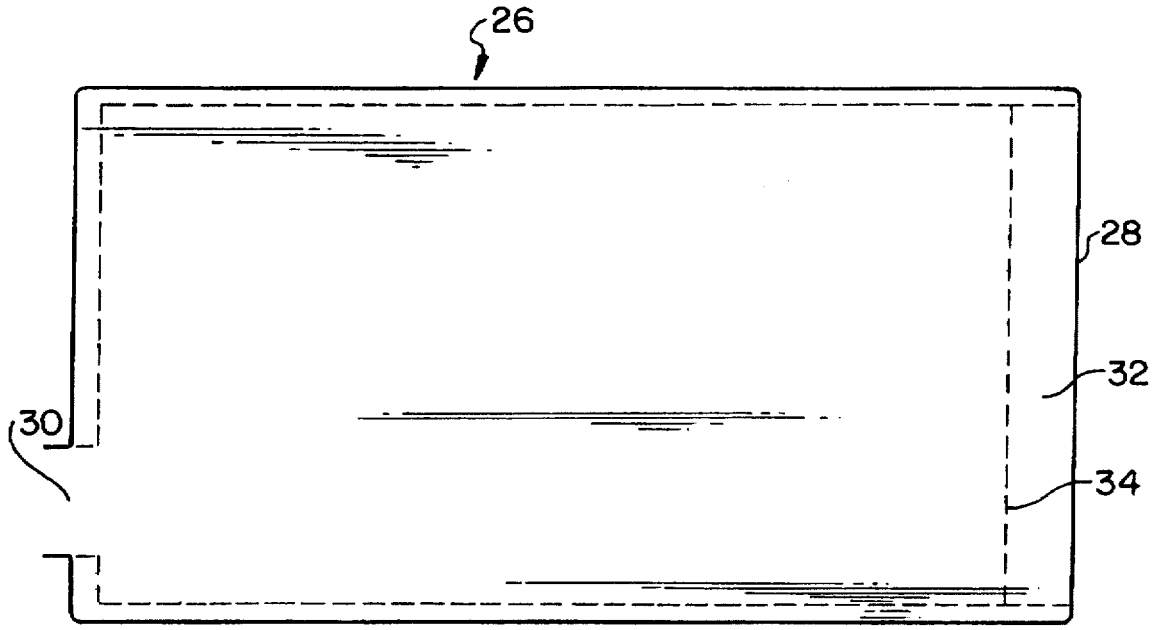
FIG. 4 is a top view of the pillow case of the present invention.

Referring to FIG. 4 a separate pillow case 26 is provided. The pillowcase 26 is substantially rectangular of a dimension slightly larger than the body support 10. The preferred embodiment of the present invention contemplates a pillowcase having dimensions approximately 26 inches by 20 inches. As is common is with pillowcases, one of the shorter ends 28 of the pillowcase is open to allow insertion of the body support 10. On the opposite shorter end, an opening 30 is provided in a position that corresponds to the position of the drawstrings on the pillow 18. Said opening 30 in the preferred embodiment has a length of approximately 5½ inches. The entire pillowcase 26 and the opening 30 are provided with a hem 32 and sewn, as depicted with reference number 34, to provide a finished edge.

The improved body support 10 of the present invention is utilized in the following manner. The body support 10 is positioned on the bed, floor or seat of the user and the user positions himself or herself thereupon. The user distributes the natural buckwheat hull granular filling according to his or her preference and may increase or decrease the amount of granular filling. It is contemplated that the user will segment a portion of the granular filling on each side of the drawstrings. As such, each side of the pillow may be stuffed with granular filling to a greater or lesser extent in comparison with side opposite the drawstrings. The drawstrings 18 are then pulled tight to retain the distribution of the filling. Since the drawstrings exit the pillow through buttonholes, the user can adjust the configuration of the pillow from the exterior of the pillow and pillowcase. As such, the pillow and pillow case work together as a unit to present an easily adjustable unit. It will be understood that by manipulating the distribution of the granular filling and by adjusting the drawstrings, a neck roll portion 36 of the pillow is formed as depicted in FIGS. 1 and 2. In such a manner, the neck roll portion 36 of the pillow can provide the desired degree of support to the neck and head of the user. In comparison with prior art pillows or body supports, the pillow of the present invention has the advantage of presenting a neck roll which operates like a solid material notwithstanding its granular composition.

It should be understood that the embodiments described herein are merely exemplary and that a person skilled in the art may make variations and modifications to these embodiments utilizing functionally equivalent elements to those described herein. Any and all modifications as well as others which may be apparent to those skilled in the art are intended to be included within the scope of the present invention as defined by the appended claims.

What is claimed is:

1. A body support comprising:

a pillow cover, said pillow cover formed from two flat pieces of material having interior facing surfaces, said pieces of material attached together along their periphery thereby forming a pocket therebetween;

means for adjustably retaining a drawstring, said means attached to said interior facing surfaces of said flat pieces of material;

at least one drawstring fitted through said means, and a granular material contained within said pocket;

whereby a user can redistribute said granular material in a predetermined configuration to define a neck support region by tightening said drawstring.

2. The body support of claim 1 wherein said means for retaining said at least one drawstring comprises loops.

3. The body support of claim 2 wherein said loops comprise loops of material.

4. The body support of claim 1 wherein said granular material comprises natural buckwheat hull.

5. The body support of claim 1 further comprising a drawstring brake, wherein said drawstring is inserted into said drawstring brake and a predetermined position of said drawstring is maintained by abutment of said drawstring brake against said pillow cover.

6. The body support of claim 1 further including a separate pillow case of a dimension slightly larger than said pillow cover.

7. The body support of claim 1 further including means for introducing said granular material into said pocket formed by said two pieces of material.

8. The body support of claim 7 wherein said means for introducing said granular material into said pocket comprises a zipper along one edge of said pillow cover which may be opened to allow introduction of said granular material.

9. The body support of claim 1 wherein said pieces of material are substantially rectangular.

10. A body support comprising:

a pillow cover, said pillow cover formed from two flat pieces of material having interior facing surfaces, said pieces of material attached together along their periphery thereby forming a pocket therebetween;

loops adjustably retaining a drawstring, said loops attached to said interior facing surfaces of said flat pieces of material;

at least one drawstring fitted through said means, a granular material contained within said pocket; and a closeble opening on said body support for the introduction of said granular material, whereby a user can modify the amount of granular material contained in said body support;

whereby a user can redistribute said granular material in a predetermined configuration by tightening said drawstring.

* * * * *